United States Patent [19]

Okie et al.

[11] 4,144,371

[45] Mar. 13, 1979

[54] FLATTENED AND BONDED FABRIC OF FOAMED VINYL PLASTISOL ON A FILAMENT CORE AND METHOD OF PREPARING SAME

[75] Inventors: James P. Okie, Wakefield; James D. Worrall, East Greenwich, both of R.I.

[73] Assignee: Engineered Yarns, Inc., Coventry, R.I.

[21] Appl. No.: 744,018

[22] Filed: Nov. 22, 1976

[51] Int. Cl.[2] ..... B32B 7/00

[52] U.S. Cl. ..... 428/255; 156/78; 156/148; 156/229; 428/245; 428/265

[58] Field of Search ..... 156/79, 148, 78, 229; 428/265, 266, 267, 268, 288, 317, 398, 399, 107, 196, 198, 245, 255, 257, 400, 108, 112, 397, 377; 264/103, 188, 289

[56] References Cited

U.S. PATENT DOCUMENTS

| | | | |
|---|---|---|---|
| 2,879,197 | 3/1959 | Muskat et al. | 156/79 |
| 2,972,554 | 2/1961 | Muskat et al. | 156/79 |
| 3,100,926 | 8/1963 | Richmond | 156/148 |
| 3,537,928 | 11/1970 | Maglio et al. | 156/79 |
| 3,574,020 | 4/1971 | Wisotzky | 156/229 |
| 3,886,015 | 5/1975 | Turner | 156/229 |
| 3,980,511 | 9/1976 | Proucelle | 156/79 |

*Primary Examiner*—James J. Bell

*Attorney, Agent, or Firm*—Fleit & Jacobson

[57] ABSTRACT

A fabric is prepared from a latent foam-encapsulated filament yarn, the fabric being either woven or non-woven. The fabric is taken to a temperature high enough to activate the foaming agent within the thread under conditions such that thread junctions are bonded together and the thread itself is flattened. The degree of flattening is controlled in order to achieve a selected percentage of open area in the resultant fabric.

39 Claims, 7 Drawing Figures

FIG. 1
PRIOR ART
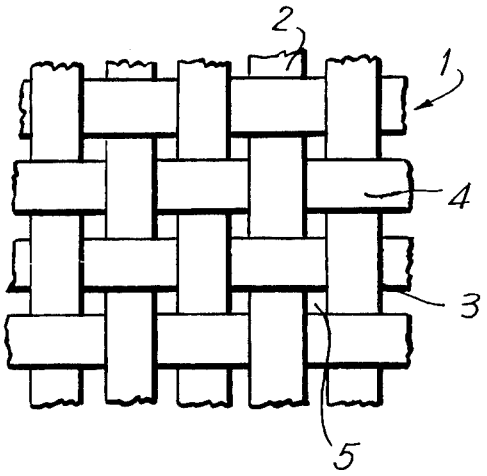
FIG. 2a
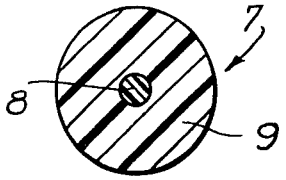
FIG. 2b
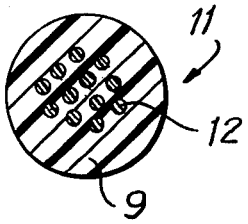
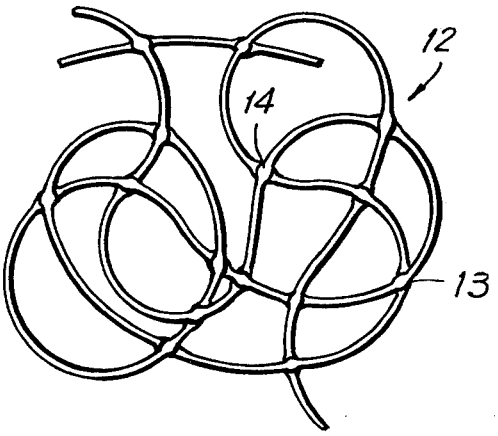
FIG. 3
FIG. 2c
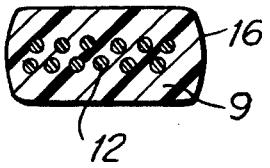
FIG. 4
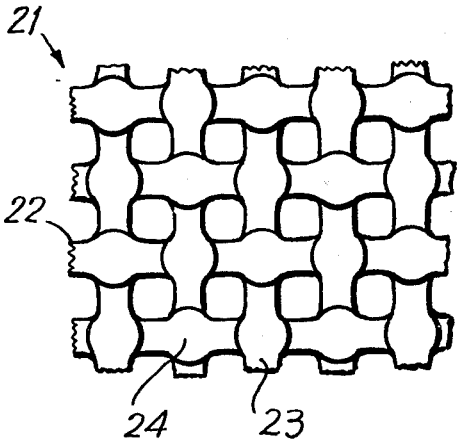

FLATTENED AND BONDED FABRIC OF FOAMED VINYL PLASTISOL ON A FILAMENT CORE AND METHOD OF PREPARING SAME

BACKGROUND OF THE INVENTION

The production of vinyl-coated synthetic yarns where the vinyl coating or encapsulation contains an unactivated foaming agent is well known. In general, the synthetic yarns are continuous filament or multi-filament yarns ranging from about 150 to about 2,200 denier, the yarns themselves generally being of nylon, rayon, glass or polyester. The synthetic core yarn is completely encapsulated in the curved vinyl plastisol and a cross-section of the coated yarn shows that where the core yarn is of multi-filament, the vinyl compound is interspersed among the individual filaments. Such a construction gives good adhesion to the core yarn; however, the major portion of the vinyl resin surrounds and encapsulates the core yarn. Normally, the vinyl content of the final thread ranges from 50 to 90% by weight thereof.

An important use for such a thread is in the preparation of fabrics, either woven or non-woven. A key feature in the process by which the fabrics are produced is that it must be possible to prepare the thread in cured form without activating the foaming agent therein. While it is possible to prepare a fabric from the thread after activation of the foaming agent, the process is uneconomical and the resultant fabric is inferior to the case wherein the process steps include curing of the thread without activation of the foaming agent prior to preparation of a fabric and activation of the foaming agent subsequent to manufacture of the fabric.

Richmond in U.S. Pat. No. 3,100,926 has described such a fabric wherein the thread is prepared in an extrusion process from a mixture of a thermoplastic resin and a blowing agent. The extruded thread is formed into a fabric-like material which is then thermally treated to decompose the blowing agent and evolve gases which have the dual effect of expanding the thermoplastic thread and welding the thermally-softened threads at juncture points in a permanent bond. Richmond shows both a non-woven fabric and a number of woven fabrics. In general, the woven fabrics are such that there is little if any open area so that such fabrics serve to screen a region completely from view, when used as curtains or area dividers. As is evident, it is the thickness of the thread in the plane of the fabric rather than in the transverse direction which is significant in determining the "opacity" or "shade-factor" of the fabric. If a thin thread is to be used to produce a desired degree of opacity then a large number of picks must be used. Conversely, if a thick thread is used then the quantity of encapsulating material necessary is high and the material cost is high.

A further difficulty with the process as disclosed by Richmond is that the extrusion temperature must be controlled within relatively narrow limits since any undue elevation of temperature during the extrusion can result in partial or complete activation of the foaming agent. Even more important, by the extrusion process, no more than a small number of threads such as 2 or 3 can be processed simultaneously by a single extruder due to the practical difficulties of dealing with yarn ends of finite length, breakage of the yarn and keeping the ends separate as they leave the single die. As is evident, then, the difficulties inherent in the extrusion process for preparing a fabric as described herein, both with respect to control of the process and with respect to the essentially cylindrical shape of the thread in its expanded form would make it desirable that a more effective and economical process and product be developed.

SUMMARY OF THE INVENTION

Organic filament yarn of a material such as rayon, nylon, or polyester, or an inorganic filament yarn such as glass is coated with a viscous plastisol such as polyvinyl chloride together with one or more plasticizers, a foaming agent and, optionally, fillers, coloring material, inhibitors, etc., these latter ingredients being conventional, drawn through a die to control the thickness of the coating and cured at a temperature low enough so that the foaming agent is not activated. As is evident, the foaming agent must be selected to have an activation temperature which is substantially higher than the curing temperature of the plastisol. Further, the filament yarn may be either a monofilament or may be a multifilament, in the latter case, the plastisol impregnating the multifilament yarn as well as encapsulating same. The sequence of steps, consisting of encapsulation, drawing through a die and curing below the activation temperature of the foaming agent may be repeated one or more times as desired, the diameter of the die being increased each time. Most important, a large number of threads or ends can be formed and processed simultaneously in a single apparatus.

The term "cure" as used herein denotes cure at least to the stage where the plastisol can withstand subsequent stresses such as are encountered in forming into a fabric, tentering, calendering and foaming under tension. Full cure produces the maximum tensile strength. Partial cure of the thread subsequent to each coating step allows for more rapid processing than when the thread is fully cured at this stage. Where the thread is only partially cured after coating, the final cure is effected during subsequent blowing, i.e., foaming.

The temperature and duration of exposure thereto for producing partial cure will vary with the plastisol and the thickness thereof. Exposure to 380° F. air for 5 – 6 seconds is a suitable set of conditions in many cases. However, for each case, suitable conditions may readily be determined by one skilled in the art.

After producing a cured thread of the desired diameter, said thread being essentially circular in cross-section, the thread is formed into a fabric, either woven or non-woven. After forming into a fabric the fabric is heated to activate the foaming agent and soften the thread. Some flattening takes place during the heating step due to the tension generated by shrinking of the yarn when said yarn is organic. Also, where the thread has been only partially cured, full cure is effected during the foaming operation. Finally the fabric may be further flattened as by calendering or by tentering while heating. The tenter frame subjects the fabric to tension in both the warp and fill directions partially flattening the fabric in the process. Surprisingly, the fabric flattens most at junctions between the warp and fill threads, welding of the warp and fill threads, welding of the warp and fill threads to each other taking place at junctions. The bond formed in this way is permanent. Further flattening of the fabric can be accomplished by passing the hot fabric through a calender. In the flattening process the open area between the threads is decreased, the decrease being proportional to the tension placed upon the threads or to the pressure of the rolls used in calendering. By these techniques the fraction of the fabric which is open can be controlled. Such control is desirable both with respect to control of traversal of the fabric by light or by moving air. In the calendering operation the thread may be flattened between junctions to essentially the same degree as at junctions.

Yet another method of flattening a woven fabric is to draw same over a succession of rolls under tension, heating the fabric as by infra-red or hot air to the point where the thread is blown and then flattened, the rolls being arranged so that both faces of the fabric are exposed in sequence to the heat source; either one or both faces of said fabric may be flattened.

Accordingly, an object of the present invention is a method of preparing a thread of a filament core encapsulated in a cured latent-foam plastisol.

Another object of the present invention is a method of simultaneously preparing a multiplicity of threads, each being a latent-foam plastisol encapsulated filament core, said threads optionally being partially cured or fully cured.

Another object of the present invention is a method of preparing a fabric with a controlled open area fraction.

A further object of the present invention is a method of preparing a fabric having junctions between threads where the threads are welded to each other at said junctions and where flattening of the threads takes place.

Still another object of the present invention is a method of preparing a fabric which optionally is flattened either on one face or on both faces thereof.

An important object of the present invention is a partially or fully cured thread comprising a filament core encapsulated in a plastisol which contains an unactivated foaming agent.

A significant object of the present invention is a fabric which is low in cost and easy to manufacture which is usable as a screen of control visual and aerial permeability.

Yet another object of the invention is a woven fabric which is optionally flat one one face or on both faces thereof.

Still other objects and advantages of the invention will in part be obvious and will in part be apparent from the specification.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is an expanded fabric in accordance with the prior art;

FIG. 2*a* is a sectional view of an encapsulated filament yarn, the yarn being a mono-filament;

FIG. 2*b* is a sectional view of an encapsulated filament yarn, the yarn being a multi-filament;

FIG. 2*c* is a sectional view of an encapsulated multifilamentary yarn after flattening in accordance with the method of the present invention;

FIG. 3 is a non-woven flattened fabric in accordance with the present invention;

FIG. 4 is a woven fabric expanded and flattened in accordance with the present invention.

DESCRIPTION OF THE PREFERRED EMBODIMENTS

Figure 5:
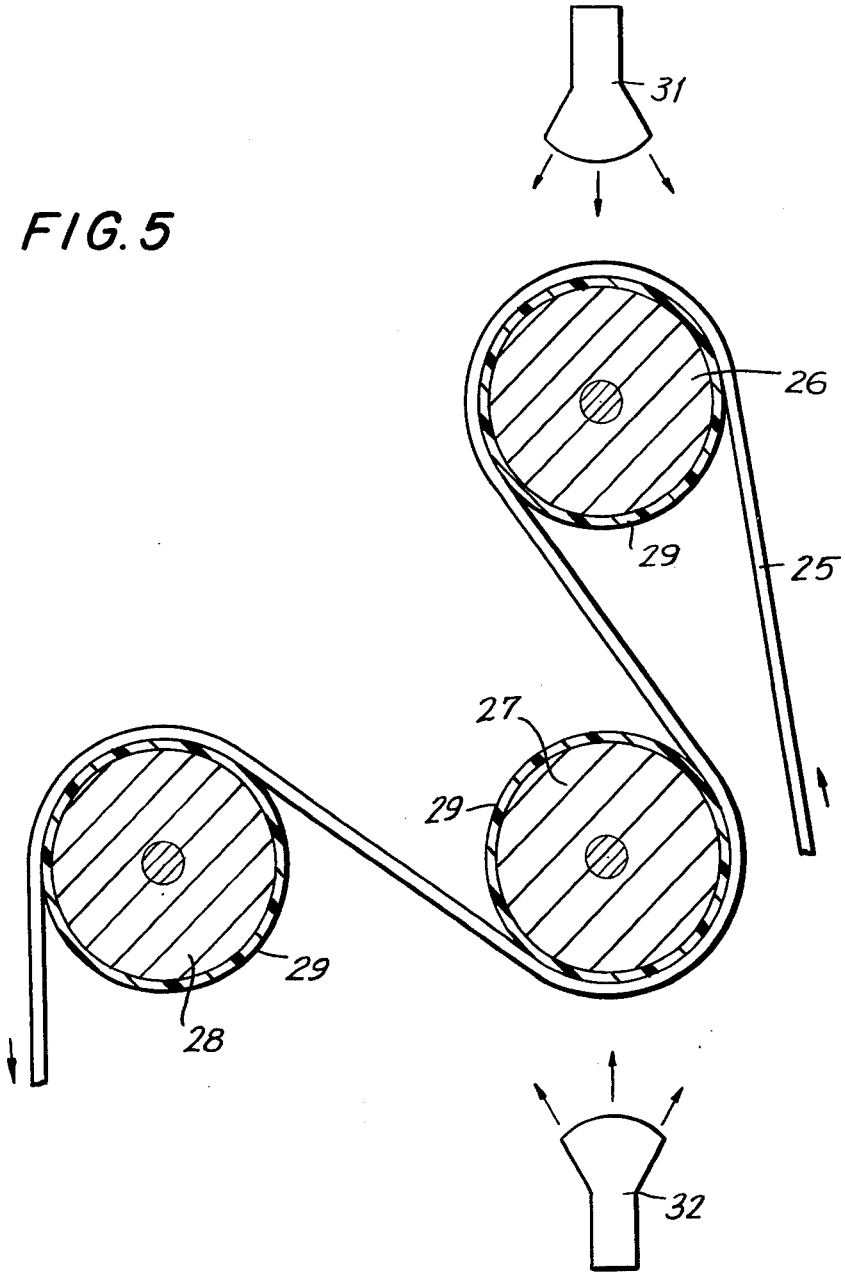
FIG. 5 is an apparatus for foaming and flattening a fabric in accordance with the present invention.

According to the present invention, a yarn which may be of a single filament or which may be a multifilament is encapsulated with a plastisol, passed through a die so that the coating on the yarn may be essentially circular in cross-section and cured, either partially or completely. The plastisol is generally polyvinyl chloride in combination with plasticizer, stabilizer, inhibitor and, especially, a foaming agent which, for activation, requires a temperature higher than the curing temperature of the plastisol. The encapsulated yarn is then cured at a temperature below the activation temperature of the foaming or blowing agent.

It is known to prepare a fabric, either woven or non-woven from a somewhat similar thread formed by extrusion. Such a fabric is shown in FIG. 1 where a woven fabric is represented generally by the reference numeral 1, the fabric being woven of warp threads 2 and fill threads 3. The warp and fill threads are welded together at junctions such as that indicated by the reference numeral 4. As can be seen, the open area which consists of the spaces between the threads, a representative space being indicated by the reference numeral 5, is relatively small. In short, little of the region on the further side of the fabric is visible to the eye. Where such a fabric is used as a wind-screen or to provide shade or privacy, it is desirable that the openings 5 be small relative to the total area. However, where relatively free flow of air therethrough is desired, a balance must be struck between the open and closed areas. Moreover, as aforenoted, the manufacture of screen-type fabrics from circular threads is unduly expensive. It might be thought that the threads sould be flattened before weaving or otherwise forming into a fabric. However, this technique proves to be infeasible due to the difficulty of orienting the thread during the formation of the fabric. The manner in which this difficulty is overcome both for woven and non-woven fabrics is illustrated in the Figures, beginning with FIG. 2*a*. FIG. 2*a* shows a thread in accordance with the present invention, the thread being indicated generally by the reference numeral 7, said thread comprising a central filament 8 of a material such as rayon, nylon, glass or polyester encapsulated in a plastisol 9. The plastisol 9 is applied to filament 8 by any convenient means such as dipping, etc. The plastisol generally is a plasticized vinyl compound containing 50 to 60% of polyvinyl chloride resin and 50 to 40% of plasticizers, fillers, pigments, stabilizers and other conventional additives. In addition, the plastisol incorporates a blowing agent. A blowing agent is selected which has an activation temperature substantially higher than the curing temperature of the plastisol. The quantity of blowing agent present depends upon the degree of expansion desired. For instance, conveniently, the quantity of blowing agent may be such that a cured thread which is 0.028 inches in diameter expands to approximately 0.054 inches in diameter. The yarn is preferably of polyester.

The plastisol-coated yarn is drawn through a circular die to give it the shape shown in FIG. 2*a* after which it is cured or partially cured at a temperature below the activation temperature of the blowing agent. Preferably the sequence of steps, namely coating, sizing by means of a die and curing is repeated once, and if desired, more than once. The purpose, of course, is to increase the final diameter of the cured thread. As aforenoted, the cure may be either partial (elimination of tackiness and providing adequate mechanical strength to withstand subsequent processing), or full.

Exactly the same process can be used with a multifilament yarn as shown in FIG. 2*b*. Here the thread represented generally by the reference numeral 11 consists of multifilament yarn 12 coated by plastisol 9. The multifilament yarn is impregnated with the plastisol 9. Significantly, as many as 80 or more threads or "ends" may simultaneously be processed. Processing a plurality of threads simultaneously results in a substantial reduction of cost, especially since a single oven will suffice for almost any number of threads. The operating temperature of the cure oven is limited by the necessity to stay below the temperature of activation of the blowing agent. The length of the oven, where the thread is moved horizontally, is limited by the increasing sag of the thread which is supported only at the ends. It is in the interest of increasing the production rate that the thread is taken so rapidly through the oven that it is only partially cured.

After curing, thread, either of the mono-filament or multi-filament type, can be formed into a non-woven fabric such as is shown in FIG. 3, the fabric being represented generally by the reference numeral 12. After forming into the non-woven fabric 12 the fabric is heated to a temperature sufficient to activate the blowing agent, and weld the thead at junctions. Flattening occurs at such junctions. While soft, the fabric may be further calendered so that the junctions formed by crossing threads such as at 13 and 14 are further flattened. Also, in the calendering process, the threads are flattened between junctions as well so that they have cross-sections as shown in FIG. 2*c* where thread 16 is based on a multi-filament yarn 12 encased in plastisol 9.

As is evident, using such a process, the thread is flattened in the plane of the fabric thus decreasing the size of the open spaces. Consequently, a desired shade factor can be achieved with a smaller weight of thread or number of threads per inch than would be the case were the thread circular in cross-section.

Where a woven fabric is prepared from the encapsulated thread, the fabric can be heated to soften the thread and to activate the blowing agent, either in tentering or in calendering exactly as in the case of the non-woven fabric illustrated in FIG. 3. Surprisingly, it is found that the fabric is flattened, by heating under tension, to a greater extent at the junction points as illustrated in FIG. 4 where the fabric, generally indicated by the reference numeral 21, consists of warp threads 22 and fill threads 23. Flattening is greatest at junction points of which junction 24 is representative. Each warp thread is bonded to each fill thread in the heating process. Moreover, the fraction of the total area of the fabric which is open can be readily established by the tension during tentering and by controlled calendering.

An alternate method of expanding the blowing agent and flattening woven fabric is illustrated in FIG. 5 wherein fabric 25 is passed over roll 26 and heated sufficiently as by infra-red source 31 or hot air, to cause blowing and softening of one face of the fabric. The fabric is then carried over roll 27, in a direction such as to bring the softened face of the fabric against said roll 27 to flatten the outer face of said fabric and weld the fabric at junctions between warp and fill. Foaming of the other face of the fabric is effected by heating same with a heat source 32. If it is desired that both faces of the fabric be flattened, the fabric, while still soft is taken over roll 28 under tension. Where the fabric is of partially-cured thread, the cure is completed during the foaming operation.

It is essential that the temperature of the various rolls be held below that at which the softened fabric will adhere to the surface of same. This temperature can readily be determined by those skilled in the art. The rolls, conveniently, may be cooled from the interiors thereof, should this step prove necessary.

As aforenoted, the preferred filament is polyester. This fabric has a tendency to shrink at the foaming temperature, this being a major reason for carrying out the foaming, flattening and welding operations under tension. Tentering overcomes the tendency to shrink both in the warp and fill directions, but in a loosely-woven fabric may pull the selvedge of the fabric loose. This difficulty is eliminated by the process illustrated in FIG. 5, but the fabric exhibits some tendency to shrinkage in the fill direction when processed in this way. The shrinkage in the fill direction can be minimized by holding the fabric tightly against the various rolls. The shrinkage is virtually eliminated by increasing the coefficient of friction between the fabric and the roll. This can be effected by roughening the surface of the rolls or by coating the rolls with a layer 29 of a high-friction material such a silicone rubber.

Where the fabric is to be used to provide shade, the opacity of the fabric should be relatively high. However, even where the fabric is to be used for shade purposes, it is generally desirable that the cooling effect of a breeze should be available. For this purpose, open area in the fabric must be provided. Such fabrics having been found suitable for awnings, screens between road lanes of opposite direction and between adjacent tennis courts, truck tarpaulins, furniture fabric, and fluorescent safety clothing of light weight. Where the fabric is to be used for fencing, the openings may be as large as 2" × 2". Thus, the open area may vary from essentially zero up to about 99%.

The continuous filament yarns to be encapsulated may range generally from about 70 to about 2200 denier. Normally, the vinyl plastisol coating comprises 50 to 90% of the total weight of the resultant thread. Conveniently, thread consisting of a single coating on a yarn 12 mils in diameter may be 20 mils in diameter, each successive coating increasing the diameter by 8 mils. As is evident, the die through which the thread is drawn after each successive coating must be larger in size than the die used in connection with the previous coating. Also, each newly applied coating must be cured to the desired degree after drawing through the sizing die, the cure being carried out at a temperature below that at which the blowing agent is activated.

As an example of the process, a continuous filament polyester yarn of 1,000 denier is double-coated to a diameter of 28 mils with a latent foam vinyl coating. This yarn has a weight of approximately one pound per thousand yards and is generally circular in cross-section with the core yarn well protected as an inner core. The cured thread may be woven into a construction of 6 picks per inch in both fill and warp. The fabric is then passed through a tenter frame at which time the fabric is held taut in both the fill and warp directions. Hot air at approximately 375° F is passed through the fabric, causing the vinyl to soften and the blowing agent to release. Under these conditions, the yarn expands from 28 mils to approximately 54 mils. At the same time, the tensions being applied to the fabric cause the thread to flatten at the points where warp and fill cross, bonding taking place at each of these points. The result is a very stable fabric of foamed, flat vinyl-coated yarns lying in the fill and warp directions. Flattening is greatest at the cross-over points, due in part to the pressure on the thread at such points. The width of the yarn is increased to approximately 65 mils, the yarn becoming smaller in thickness simultaneously.

Further flattening can be accomplished by calendering the fabric while it is still soft. A round 28 mil yarn in a woven construction can be flattened to 90 mils in width while still protecting the core yarn and retaining 30% of the foam structure. Flattening by the three-rolls process illustrated in FIG. 5 yields an essentially similar product.

The product has great resistance to outdoor weathering and can be produced in a multitude of colors. The product also has good abrasion resistance and the core yarn is protected from deterioration by sunlight. It can be used for outdoor fencing around gardens, patios, miscellaneous enclosures, and especially for fencing material to cut down the glare of lights between parallel opposing lanes of traffic on a highway. It can also be used for barrier fences in ski areas, for home shade cloth and protection against wind. Depending on the open area, both controlled visibility and air-flow can be achieved.

Calendering of fabric while in softened condition, where the fabric is formed of latent foam thread made by any process including that taught herein may be carried out for the purpose of flattening the thread and controlling the shade factor. Also, as aforenoted, such calendering provides a desired shade factor or degree of opacity with a smaller quantity of thread than would be the case where the thread is essentially cylindrical (except at junctions between crossing threads).

The materials used are conventional and readily available. For instance, a suitable blowing agent is azodicarbonamide which decomposes between 302° and 392° F., is sold under the name of Azocel, and is manufactured by Fairmount Chemical Company, Inc., Newark, New Jersey.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

CLAIMS

What is claimed is:

1. In a method of producing a fabric of thread, said thread comprising a foamed resin on a core of yarn wherein junctions between threads are bonded together, the improvement comprising, in sequence, the steps of applying a plastisol compound containing an effective amount of a foaming agent therein as a viscous liquid to a filament yarn as a core to encapsulate said yarn, the activation temperature of said foaming agent being higher than the curing temperature of said plastisol, drawing said encapsulated yarn through a sizing die to bring the encapsulated yarn to a selected thickness, and curing said thread at least to a degree such that said thread can withstand subsequent stresses in forming into a finished fabric, said degree ranging from partial cure to full cure, at a temperature below that at which said foaming agent is activated.

2. The method as defined in claim 1, wherein said sequence of encapsulation, sizing and curing is repeated at least once, the aperture of the sizing die being increased by a selected amount at each repetition of said sequence.

3. The method as defined in claim 2, further comprising the steps of weaving a fabric of said cured thread, passing said fabric through a tenter frame which applies tension to said fabric in both the warp and fill directions while heating said fabric to a temperature high enough to activate said foaming agent and soften said fabric, whereby said thread where only partially cured is completely cured, simultaneously expands and is flattened and bonded at the points where warp and fill cross.

4. The method as defined in claim 3, further comprising the step of calendering said fabric subsequent to passing same through a tenter frame and while said fabric is in softened condition, thereby further flattening said fabric and reducing the open area thereof.

5. The method as defined in claim 2, further comprising the steps of forming a fabric of said cured thread, heating said cured thread to activate said foaming agent, soften said thread, and complete the cure thereof when only partially cured, and calendering said fabric to flatten same while soft, thereby decreasing the open area of said fabric and welding said fabric at thread junctions.

6. The method as defined in claim 1, further comprising the steps of weaving a fabric of said at least partially cured thread, passing said fabric through a tenter frame which applies tension to said fabric in both the warp and fill directions while heating said fabric to a temperature high enough to activate said foaming agent and soften said fabric, whereby said thread where only partially cured is fully cured and simultaneously is expanded and flattened and is bonded at the points where warp and fill cross.

7. The method as defined in claim 1, further comprising the steps of forming a fabric of said at least partially cured thread, heating said cured thread to activate said foaming agent and soften said thread and fully cure same where only partially cured, and calendering said fabric to flatten same while soft, thereby decreasing the open area of said fabric and welding said fabric at thread junctions.

8. The method as defined in claim 1, futher comprising the steps of weaving a fabric of said at least partially cured thread, passing said fabric over a first roll, heating that face of said fabric away from said first roll, said face hereinafter being termed the first face of said fabric, said first face being heated to a temperature sufficient to complete the cure of said thread where only partially cured, to foam said thread and to soften said thread, and passing said fabric over a second roll in a direction such that said first face of said fabric makes contact with said second roll, said fabric being under tension in the warp direction, whereby said first face of said fabric is flattened and the threads of said fabric are welded together at junctions of warp and fill threads.

9. The method as defined in claim 8, further comprising the steps of heating that face of said fabric opposite said first face, said opposite face being hereinafter termed the second face, to a temperature high enough to complete the cure of said second face of said fabric where the thread comprising said second face is only partially cured, to foam the thread of said second face and to soften same, and passing said fabric over a third roll under tension in the warp direction with said second face making contact with said third roll while soft, whereby said second face is flattened.

10. The method as defined in claim 8, wherein the surface of said rolls provides a high coefficient-of-friction between said rolls and said fabric for the purpose of minimizing or eliminating shrinkage in the fill direction.

11. The method as defined in claim 9, wherein the surface of said rolls has thereon ao coating which provides a high coefficient-of-friction between said rolls and said fabric for the purpose of minimizing or eliminating shrinkage in the fill direction.

12. The method as defined in claim 1, wherein said filament yarn is a polyester, rayon, glass or nylon.

13. The method as defined in claim 1, wherein said filament yarn is a polyester.

14. The method as defined in claim 2, wherein said filament yarn is a polyester, rayon, glass or nylon.

15. The method as defined in claim 2, wherein said filament yarn is a polyester.

16. The method as defined in claim 1, wherein said filament yarn is about 1000 denier, and after encapsulating and curing the resultant thread is about 0.028 inches in diameter and the quantity of foaming agent is such that on activation said foaming agent expands said thread to a diameter of approximately 0.059 inches.

17. The method as defined in claim 2, wherein said filament yarn is about 1000 denier, and after encapsulating and curing the resultant thread is about 0.028 inches in diameter and the quantity of foaming agent is such that on activation said foaming agent expands said thread to a diameter of approximately 0.059 inches.

18. The method as defined in claim 16, wherein the tension applied during tentering is such as to flatten said thread to about 0.090 inches in width.

19. The method as defined in claim 1, wherein said filament yarn is of nylon, rayon or polyester in a size ranging from about 70 to about 2200 denier.

20. A method of producing a fabric of a flattened encapsulated yarn, comprising the steps of passing a fabric woven of thread of at least partially cured latent foam-encapsulated yarn, a partially cured thread being one which can withstand the stress of weaving the tentering, said thread being essentially circular in cross-section, through a tenter frame which applies tension on both the warp and fill directions while heating said fabric to a temperature high enough to activate the foaming agent in said thread, soften said thread and complete the cure of said thread where only partially cured, whereby said thread simultaneously expands and is flattened and bonded at the points where warp and fill cross.

21. A ravel-resistant, generally planar fabric comprising a yarn of core filament coated with foamed vinyl resin, said core filament consisting of multi-filament yarn, said vinyl resin applied to said core filament as a viscous liquid, said yarn being arranged in a pattern such as to form yarn junctions, and being generally flattened in the plane of said fabric and bonded at said junctions.

22. The fabric as defined in claim 21, wherein the degree of flattening of said yarn is greater at said junctions than in the remainder thereof.

23. The fabric as defined in claim 21, wherein said core filament ranges from 70 to 2200 denier.

24. The fabric as defined in claim 21, wherein said core filament is of rayon, nylon or polyester.

25. The fabric as defined in claim 24, wherein said core filament is of polyester.

26. The fabric as defined in claim 21, wherein said fabric is of woven construction.

27. The fabric as defined in claim 21, wherein said fabric has an open area essentially uniformly distributed therethrough, said open area ranging from zero percent to about 99 percent of the total area of said fabric.

28. The fabric as defined in claim 26, wherein said fabric has an open area essentially uniformly distributed therethrough, said open area ranging from zero percent to about 99 percent of the total area of said fabric.

29. The method as defined in claim 1, wherein said plastisol is a vinyl plastisol.

30. The method as defined in claim 1, wherein said plastisol is a polyvinyl chloride plastisol.

31. An expansible thread, comprising a multifilament core yarn of a material selected from the group consisting of nylon, rayon, polyester and glass, encapsulated in a plastisol containing a foaming agent, said plastisol applied to said core yarn as a viscous liquid, said plastisol being less than fully cured and cured to the point where it can withstand the stresses of subsequent processing.

32. An expansible thread, as defined in claim 31, wherein said plastisol is a vinyl plastisol.

33. An expansible thread as defined in claim 31, wherein said plastisol is a polyvinyl chloride plastisol.

34. An expansible thread as defined in claim 31, wherein said core yarn is polyester.

35. The method as defined in claim 1, wherein a plurality of threads are simultaneously manufactured by the steps of coating a core yarn with latent foam plastisol, passing through dies and at least partial curing of said plastisol.

36. The method as defined in claim 2, wherein a plurality of threads are simultaneously manufactured by the steps of coating a core yarn with latent foam plastisol, passing through dies and at least partial curing of said plastisol.

37. A method of forming a flattened fabric of thread of foamed plastisol around multifilament core, comprising the steps of forming a fabric of at least partially cured thread of latent-foam plastisol or filament thread, heating said fabric to activate the foaming agent in said plastisol, to soften said plastisol and to complete the cure of same where only partially cured, and calendering said fabric to flatten same to a selected degree, whereby said thread is welded at junctions.

38. A method of producing a fabric of a flattened impregnated and encapsulated yarn, the method comprising the steps of: weaving a fabric of threads having a multifilament core coated with a foaming agent and a resin which are applied to said core as a viscous liquid; heating said woven fabric to a temperature high enough to activate said foaming agent and soften the fabric, thereby simultaneously expanding and flattening said threads and bonding said threads at the points where warp and fill threads cross.

39. The method recited in claim 38, wherein said step of heating is carried out in a tenter frame, while tension is applied to said fabric in both warp and fill directions.

* * * * *

UNITED STATES PATENT AND TRADEMARK OFFICE

CERTIFICATE OF CORRECTION

PATENT NO. : 4,144,371

DATED : March 13, 1979

INVENTOR(S) : James P. Okie and James D. Worrall

It is certified that error appears in the above—identified patent and that said Letters Patent is hereby corrected as shown below:

In claim 20, line 5, delete "the" second occurrence, and insert --and--.

Signed and Sealed this

*Sixteenth* Day of *December 1980*

[SEAL]

*Attest:*

SIDNEY A. DIAMOND

*Attesting Officer*

*Commissioner of Patents and Trademarks*